US011413205B2

(12) United States Patent
Dalbert

(10) Patent No.: US 11,413,205 B2
(45) Date of Patent: Aug. 16, 2022

(54) SYSTEM COMPRISING AN OPERATING TABLE, AN AIR BLADDER, AND AN AIR COMPRESSOR

(71) Applicant: TRUMPF MEDIZIN SYSTEME GMBH + CO. KG, Saalfeld (DE)

(72) Inventor: Heinz-Hermann Dalbert, Bruckmuehl (DE)

(73) Assignee: TRUMP MEDIZIN SYSTEME GMBH + CO. KG, Saalfeld (DE)

( * ) Notice: Subject to any disclaimer, the term of this patent is extended or adjusted under 35 U.S.C. 154(b) by 245 days.

(21) Appl. No.: 16/751,634

(22) Filed: Jan. 24, 2020

(65) Prior Publication Data

US 2020/0237597 A1 Jul. 30, 2020

(30) Foreign Application Priority Data

Jan. 29, 2019 (EP) ..... 19154329

(51) Int. Cl.
*A61G 13/08* (2006.01)
*A61G 13/10* (2006.01)

(52) U.S. Cl.
CPC ..... *A61G 13/08* (2013.01); *A61G 13/10* (2013.01); *A61G 2203/10* (2013.01)

(58) Field of Classification Search
CPC ..... A61G 13/08; A61G 13/02; A61G 13/10; A61G 2203/10
See application file for complete search history.

(56) References Cited

U.S. PATENT DOCUMENTS

| | | | | |
|---|---|---|---|---|
| 5,613,254 | A | 3/1997 | Clayman | |
| 6,351,678 | B1 * | 2/2002 | Borders | A61H 9/0078 700/83 |
| 6,357,066 | B1 | 3/2002 | Pierce | |
| 6,401,283 | B2 * | 6/2002 | Thomas | A47C 27/086 5/740 |
| 7,287,289 | B1 * | 10/2007 | Hagopian | A61G 7/05769 5/600 |
| 2005/0097675 | A1 * | 5/2005 | Borders | A61G 13/12 5/713 |
| 2012/0264997 | A1 | 10/2012 | Isham | |

FOREIGN PATENT DOCUMENTS

| | | |
|---|---|---|
| EP | 0292218 | 5/1988 |
| EP | 0821928 | 2/1998 |
| EP | 2601926 | 6/2013 |

* cited by examiner

*Primary Examiner* — Fredrick C Conley
(74) *Attorney, Agent, or Firm* — Barnes & Thornburg LLP

(57) ABSTRACT

The present disclosure relates to a system comprising an operating table, and air bladder, and an air compressor, in particular, to a system which is used for kidney surgery.

16 Claims, 2 Drawing Sheets

SYSTEM COMPRISING AN OPERATING TABLE, AN AIR BLADDER, AND AN AIR COMPRESSOR

CROSS-REFERENCE TO RELATED APPLICATIONS

This application claims the benefit of European Patent Application Serial No. 19154329.7, filed on Jan. 29, 2019, the entire disclosure of which is incorporated herein by reference in its entirety.

TECHNICAL FIELD

The present disclosure relates to a system comprising an operating table, an air bladder, and an air compressor, in particular, to a system which is used for kidney surgery.

BACKGROUND

Hitherto, for performing surgical intervention in the field of kidneys, special mechanical configurations of an operating table have been requested. Usually, a so-called kidney bridge was installed between two sections of a tabletop of the operating table, namely between a seat section and a back section of the tabletop. This kidney bridge served for flexing a patient in a lateral position for a better access to a point of interest in the region of the kidneys.

However, due to the additional mechanical parts and actuators, a range of movement of a column head of the operating table supporting the tabletop was limited which deteriorated the chance of positioning a patient into a convenient position. Furthermore, a position of the patient in a longitudinal direction of the operating table with respect to the kidney bridge had to be adjusted before the surgery and this position was hard to be altered during surgery if another position would be more suitable. The reason is that the entire body of the patient had to be moved which was very difficile since the patient was anesthetized and fixed to the tabletop. Moreover, upon using the kidney bridge, pressure points and, therefore, damages of the skin occurred.

Therefore, the object underlying the present disclosure is to remedy the above-mentioned disadvantages and to provide a system for operating a patient support apparatus which enables a flexible positioning of the patient.

SUMMARY

The present disclosure includes one or more of the features recited in the appended claims and/or the following features which, alone or in any combination, may comprise patentable subject matter.

According to an aspect of the present disclosure, a system comprises an operating table, an air bladder, and an air compressor, wherein the operating table comprises a tabletop including an upper deformable portion and a lower rigid portion. The tabletop is configured to host the air bladder between the upper deformable portion and the lower rigid portion, and the air bladder is configured to be inflated by the air compressor.

By this configuration, flexing of a patient's body without additional mechanical parts and their disadvantages of limiting a range of movement of a column head and, furthermore, providing a flexibility in positioning and a protection of the skin of the patient are possible.

In an embodiment of the system, the operating table comprises a split pad, the split pad comprises a first layer and a second layer configured to host the air bladder between the layers, and the first layer provides at least a portion of the upper deformable portion and the second layer provides at least a portion of the lower rigid portion.

When the split pad is provided, the second layer forming the lower rigid portion can be attached to a rigid plate of the tabletop such that the split pad is immovably attached to the tabletop and the split pad cannot slip out of position. Nevertheless, the first layer forming the upper deformable portion can deform with respect to the second layer forming the lower rigid portion such that it can follow a change of the shape of the bladder.

In an embodiment of the system, the tabletop is configured such that the air bladder is movable when being hosted between the upper deformable portion and the lower rigid portion.

Due to this movability, an altered position of the point of application of the flexing with respect to the patient's body is easily possible even when the patient's body is immovably fixed to the tabletop.

In a further embodiment of the system, the tabletop comprises several sections respectively linked by a joint, and the air bladder is movable into a position adjacent to one of the joints.

Due to this configuration, a support for convenient positions for specific surgical interventions is possible.

According to a further embodiment of the system, the tabletop is configured to provide a position of a patient's body for a kidney surgery.

In this case, the tabletop provides a sufficient movability of the several sections of the tabletop, in particular, of the back section with respect to the seat section, so that in combination with the air bladder, a suitable positioning of the patient's body and a convenient access to a kidney of the patient for the kidney surgery are possible.

In a further embodiment of the system, the system comprises a control panel configured to control an air pressure in the air bladder.

By the provision of such a control panel, an adjustment of the air pressure in the air bladder and, therefore, an extension of the air bladder for achieving a suitable position of the patient's body for a respective intervention is easily possible.

In a further embodiment of the system, at least one of the air bladder and the air compressor comprises a pressure sensor detecting the air pressure in the air bladder, and a controller controlling the air compressor is configured to process the detected air pressure and to provide a constant air pressure set at the control panel.

In this configuration, the system can ensure a constant position of the patient's body in order to maintain the convenient position for the respective surgical intervention so as to assist in a safe surgical intervention.

According to a further embodiment of the system, the system further comprises a foam pad positioned between the air bladder and a patient's body.

The air pad between the air bladder and the patient's body assists in avoiding pressure points and, therefore, skin damage.

According to another aspect of the present disclosure, a method includes the step of inflating air pressure into the air bladder hosted in the tabletop by the air compressor and thereby deforming the upper deformable portion of the tabletop, and adjusting the air pressure in the air bladder such that a requested position of a patient's body is achieved by the deformation of the upper deformable portion.

By this method, flexing of a patient's body without additional mechanical parts and their disadvantages of limiting a range of movement of a column head and, furthermore, providing a flexibility and a protection of the skin of the patient are possible.

In an embodiment of the method, it further includes the step of adjusting a position of the air bladder by moving the air bladder hosted between the upper deformable portion and a lower rigid portion of the tabletop.

By this step, an altered position of the point of application of the flexing with respect to the patient's body is easily possible even when the patient is anesthetized and immovably fixed to the tabletop.

In a further embodiment of the method, it includes the step of actively maintaining the air pressure constant by the air compressor during a requested period.

Due to this step, the system can ensure a constant position of the patient's body in order to maintain the convenient position for the respective surgical intervention so as to assist in a safe surgical intervention.

According to a further embodiment of the method, it further includes the step of varying air pressure in the air bladder for changing the position of the patient's body according to a modified request.

When the air pressure in the air bladder is varied, the position of the patient's body can be altered in a controlled manner so as, if requested, to enhance accessibility of specific organs of the patient's body.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
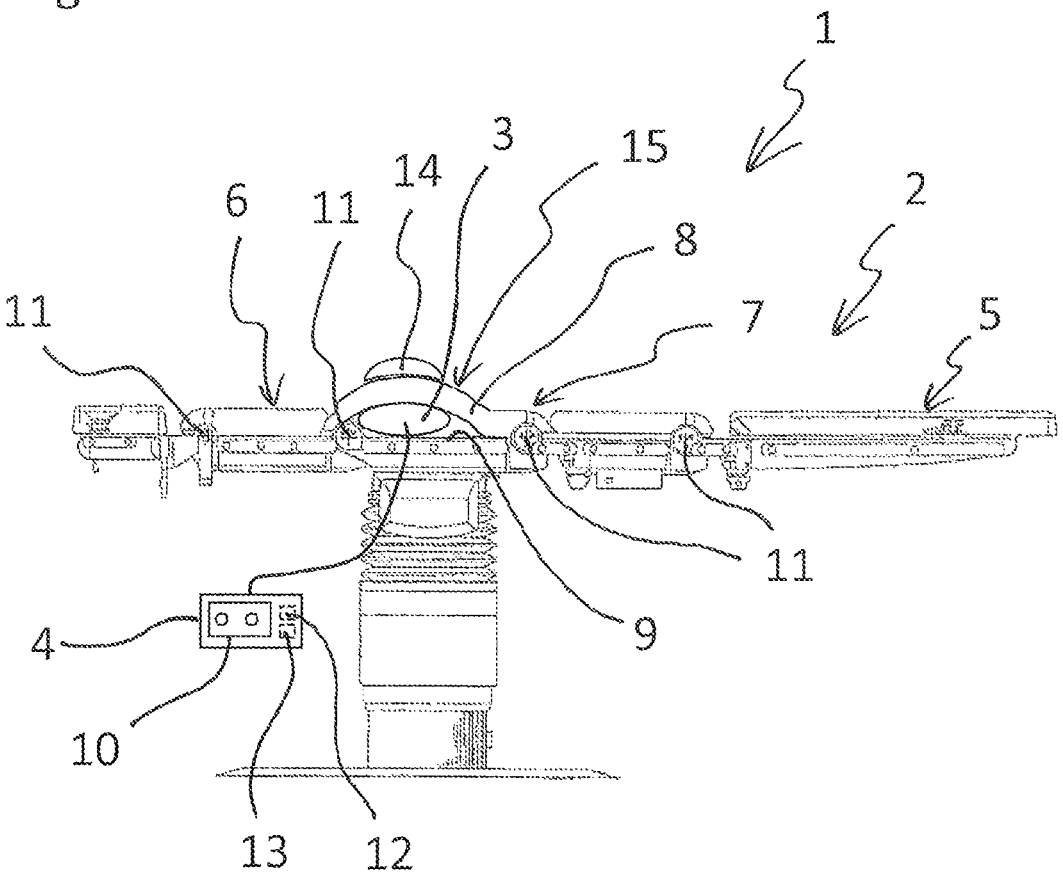
FIG. 1 shows a system according to an embodiment of the present disclosure.

FIG. 1 shows a system 1 according to an embodiment of the present disclosure. The system 1 comprises an operating table 2, an air bladder 3, and an air compressor 4.

The operating table 2 comprises a tabletop 5 including several sections. Amongst others, in this embodiment, the tabletop 5 includes a back section 6 and a seat section 7 which are formed as respectively including an upper deformable portion 8 and a lower rigid portion 9.

The upper deformable portion 8 of the seat section 7 is formed by a first layer of a split pad 15 and the lower rigid portion 9 is formed by a second layer of the split pad 15. The upper first and the second layer are joined to each other in a portion at a defined end of the split pad 15. Alternatively, the layers of the split pad 15 are not joined to each other. The first layer and the second layer respectively comprise different structures for respectively having a different stiffness. Alternatively, the first layer and the second layer have a same structure and the stiffness of the lower rigid portion 9 is caused by a rigid plate to which the second layer of the split pad 15 is attached. As a further alternative, the upper deformable portion 8 is formed by a bolster of the tabletop 5 and the lower rigid portion 9 is formed by a rigid plate-shaped component of the seat section of the tabletop 5. In this embodiment, the split pad 15 is formed so as to cover a face of one of the sections of the tabletop 5, however, in alternative embodiments, one split pad 15 or one bolster as the upper deformable portion 8 can cover several sections or the entire face of the tabletop 5. Optionally, the plate-shaped component can be made of a radiolucent material.

The air bladder 3 is inflatable by the air compressor 4. The system 1 comprises a control panel 10 configured to control an air pressure in the air bladder 3. The control panel 10 comprises operating elements for inflating air pressure into the air bladder 3 and for releasing the air pressure from the air bladder 3. Alternatively, the operating elements enable a setting of the air pressure in the air bladder 3. The operating elements operate a controller 13 which is included in the control panel 10 or, alternatively, in the compressor 4. The compressor 4 comprises a pressure sensor 12. The pressure sensor 12 detects air pressure in the air bladder 3 and the controller 13 controlling the air compressor 4 processes the detected air pressure to provide a constant air pressure set at the control panel 10. The controller 13 is an electronic controller, however, in an alternative embodiment, the controller is a pneumatic controller. Alternatively, the pressure sensor 12 is not provided and the air pressure in the air bladder is adjusted manually.

The sections of the tabletop 5, in particular, the back section 6 and the seat section 7 are linked by a joint 11. In this embodiment, also the remaining sections are respectively linked by the joints 11, however, in an alternative embodiment, not all of the sections are linked by the joints 11 but they are rigidly linked.

The system 1 hosts the air bladder 3 between the upper deformable portion 8 and the lower rigid portion 9 of the tabletop 5. The air bladder 3 is movable when being hosted between the upper deformable portion 8 and the lower rigid portion 9, in particular, the air bladder 3 is movable into a position adjacent to one of the joints 11. Furthermore, in particular, the air bladder 3 is movable into a position adjacent to the joint 11 linking the back section 6 and the seat section 7. In the shown position, in connection with the joints 11, the tabletop 5 is configured to provide a position of a patient's body (not shown) suitable for a kidney surgery when the patient's body is placed on the tabletop 5 as usual.

The system 1 further comprises a foam pad 14 positioned between the air bladder 3 and a patient's body (not shown). Alternatively, the foam pad 14 is not provided.

Figure 2:
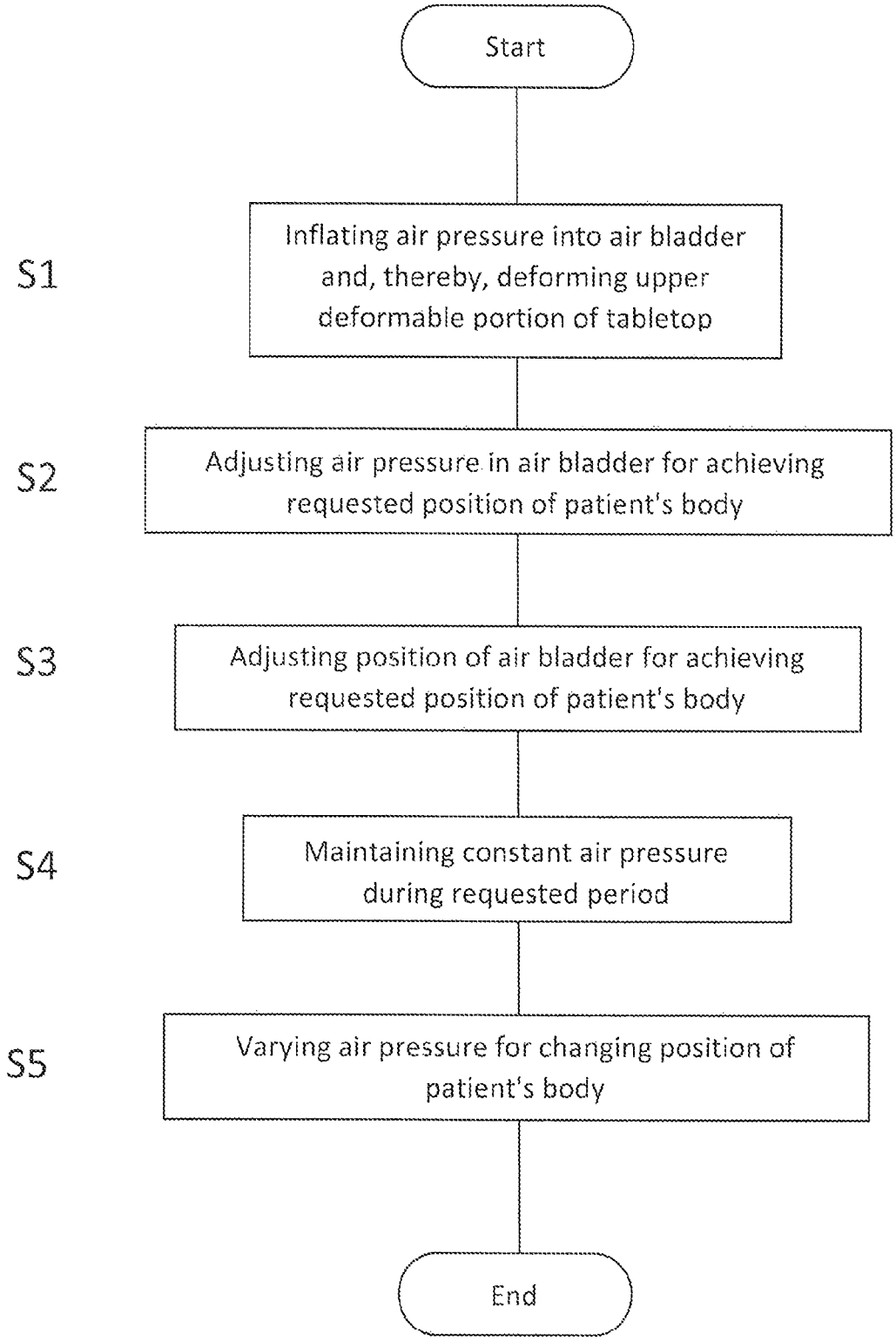
FIG. 2 shows a flowchart illustrating a method according to the present disclosure.

FIG. 2 shows a flowchart illustrating a method according to the present disclosure. In use, in step S1, the air pressure is inflated by the air compressor 4 into the air bladder 3 hosted in the tabletop 5 and, thereby, the upper deformable portion 8 of the tabletop 5 is deformed. The upper deformable portion 8 is upwardly bent by the air bladder 3 so as to provide a shape of the surface of the tabletop 3 to generate a flexed position of the patient's body. In step S2, the air pressure in the air bladder 3 and, in step S3, a position of the airbladder 3 are adjusted such that a requested position of a patient's body is achieved by the deformation of the upper deformable portion 8. Therefore, the air bladder 3 is moved between the upper deformable portion 8 and the lower rigid portion 9 into a suitable position. The sequence of adjusting the air pressure and the position is not fix and it also can be an iterative process. In case of a kidney surgery, the suitable position is close to the joint 11 between the back section 6 and the seat section 7. Thereby, the flexed position of the patient's body suitable for kidney surgery is provided.

Alternatively, the air bladder 3 is already in a suitable position for a planned surgery so that adjustment thereof is not necessary. Furthermore, alternatively, the suitable position is not close to the joint 11 between the back section 6 and the seat section 7 but at another suitable location.

In step 4, the air pressure is actively maintained constant during a requested period by the air compressor 4. The detected air pressure in the air bladder 3 is processed by the controller and the air pressure is adjusted by the air compressor 4. In particular, during the surgical intervention when the surgeon operates in a wound of the patient's body, a constant position of the body is important in order not to injure the patient. Alternatively, an actively maintained constant air pressure is not necessary since. e.g., the system of the compressor 4 and the air bladder 3 is tight enough for passively maintaining the air pressure in a suitable manner.

The air pressure is varied in step S5 for changing the position of the patient's body according to a modified request. In the course of a surgery, e.g. a modified position of the patient's body can be necessary. Hence, the air pressure in the air bladder 3 is varied. Alternatively, the air pressure is maintained constant during the entire surgery and released when the surgical intervention is finished.

While the present disclosure has been illustrated and described in detail in the drawings and the foregoing description, such illustration and description are to be considered illustrative or exemplary and not restrictive. The invention is not limited to the disclosed embodiments. From reading the present disclosure, other modifications will be apparent to a person skilled in the art. Such modifications may involve other features, which are already known in the art and may be used instead of or in addition to features already described herein. In the claims, the word "comprising" does not exclude other elements or steps, and the indefinite article "a" or "an" does not exclude a plurality.

Although this disclosure refers to specific embodiments, it will be understood by those skilled in the art that various changes in form and detail may be made without departing from the subject matter set forth in the accompanying claims.

The invention claimed is:

1. A system comprising an operating table, an air bladder, and an air compressor, wherein the operating table comprises a tabletop comprising an upper deformable portion and a lower rigid portion, the tabletop is configured to selectively and removably receive the air bladder between the upper deformable portion and the lower rigid portion, the air bladder is configured to be inflated by the air compressor, wherein the tabletop is configured such that the air bladder is accessible and repositionable when positioned between the upper deformable portion and the lower rigid portion, and the repositioning of the air bladder changes a position of a patient's body.

2. The system of claim 1, wherein the operating table comprises a split pad, the split pad comprises a first layer and a second layer configured to selectively receive the air bladder between the layers, and the first layer provides at least a portion of the upper deformable portion and the second layer provides at least a portion of the lower rigid portion.

3. The system of claim 1, wherein the tabletop comprises several sections respectively linked by a joint, and the air bladder is movable into a position adjacent to one of the joints.

4. The system of claim 3, wherein the tabletop is configured to provide a position of the patient's body suitable for a kidney surgery.

5. The system of claim 1, wherein the system comprises a control panel configured to control an air pressure in the air bladder.

6. The system of claim 5, wherein at least one of the air bladder and the air compressor comprises a pressure sensor detecting the air pressure in the air bladder, and a controller controlling the air compressor is configured to process the detected air pressure and to provide a constant air pressure set at the control panel.

7. The system of claim 1, wherein the system further comprises a foam pad provided to be positioned between the air bladder and the patient's body.

8. A method for operating the system of claim 1 including the steps:

inflating air pressure into the air bladder received in the tabletop by an air compressor and, thereby, deforming the upper deformable portion of the tabletop (S1), and adjusting the air pressure in the air bladder such that a requested position of the patient's body is achieved by the deformation of the upper deformable portion (S2).

9. The method of claim 8, further including the step:

adjusting a suitable position of the air bladder by moving the air bladder hosted between the upper deformable portion and a lower rigid portion of the tabletop (S3).

10. The method of claim 9, further including the step:

varying the air pressure in the air bladder for changing the position of the patient's body according to a modified request (S5).

11. The method of claim 9, further including the step:

actively maintaining the air pressure constant by the air compressor during a requested period (S4).

12. The method of claim 11, further including the step:

varying the air pressure in the air bladder for changing the position of the patient's body according to a modified request (S5).

13. A method for operating a system comprising an operating table, an air bladder, and an air compressor, the method including the steps:

selectively positioning the air bladder between an upper deformable portion and the lower rigid portion of a portion of a tabletop of the operating table, inflating air pressure into the air bladder received in the tabletop by an air compressor and, thereby, deforming the upper deformable portion of the tabletop (S1), and adjusting the air pressure in the air bladder such that a requested position of a patient's body is achieved by the deformation of the upper deformable portion (S2), adjusting a suitable position of the air bladder by moving the air bladder within the space between the upper deformable portion and a lower rigid portion of the tabletop (S3).

14. The method of claim 13, further including the step:

actively maintaining the air pressure constant by the air compressor during a requested period (S4).

15. The method of claim 14, further including the step:

varying the air pressure in the air bladder for changing the position of the patient's body according to a modified request (S5).

16. The method of claim 13, further including the step:

varying the air pressure in the air bladder for changing the position of the patient's body according to a modified request (S5).

* * * * *